US011744388B2

(12) United States Patent
Pratsch

(10) Patent No.: US 11,744,388 B2
(45) Date of Patent: Sep. 5, 2023

(54) PRODUCT DISPLAY SYSTEM AND METHOD

(71) Applicant: WESTROCK CONTAINER, LLC, Atlanta, GA (US)

(72) Inventor: Jeffrey P. Pratsch, Crystal, MN (US)

(73) Assignee: WESTROCK CONTAINER, LLC, Atlanta, GA (US)

( * ) Notice: Subject to any disclaimer, the term of this patent is extended or adjusted under 35 U.S.C. 154(b) by 532 days.

(21) Appl. No.: 16/525,795

(22) Filed: Jul. 30, 2019

(65) Prior Publication Data

US 2020/0037787 A1 Feb. 6, 2020

Related U.S. Application Data

(60) Provisional application No. 62/713,048, filed on Aug. 1, 2018.

(51) Int. Cl.

| | |
|---|---|
| ***A47F 5/11*** | (2006.01) |
| ***G09F 15/00*** | (2006.01) |
| ***G09F 23/00*** | (2006.01) |

(52) U.S. Cl.

CPC ..... *A47F 5/114* (2013.01); *A47F 5/116* (2013.01); *G09F 15/0062* (2013.01); *G09F 23/00* (2013.01)

(58) Field of Classification Search

CPC .. A47F 5/114; A47F 5/116; A47F 2005/0075; A47F 5/11; A47F 5/112; G09F 15/0062; G09F 23/00; A47B 87/005; A47B 43/02; A47B 47/06; A47B 55/06; B65D 5/52; B65D 5/5213

USPC ..... 211/72, 135, 85.1; 206/736, 742, 751; 229/120.14, 120.15

See application file for complete search history.

(56) References Cited

U.S. PATENT DOCUMENTS

| | | | | |
|---|---|---|---|---|
| 2,291,265 | A * | 7/1942 | Viglietta | A47F 5/114 108/60 |
| 3,126,844 | A * | 3/1964 | Burne et al. | A47F 5/116 108/179 |
| 3,231,097 | A * | 1/1966 | Hodson | A47F 5/00 248/220.42 |
| 3,243,047 | A * | 3/1966 | Witteborg | A47F 7/148 211/41.1 |
| 3,425,764 | A * | 2/1969 | Budd | A47B 79/00 312/259 |
| 4,374,560 | A * | 2/1983 | Howlett | A47F 5/114 229/104 |

(Continued)

*Primary Examiner* — Jennifer E. Novosad
(74) *Attorney, Agent, or Firm* — Rohini K. Garg

(57) ABSTRACT

A product display system includes a product-support structure with a plurality of cabinets, a plurality of spacers, a base tray, and a cover plate. The cabinets and spacers are inserted into a cavity in the base tray in an alternating pattern around a peripheral wall of the base tray and the cover plate is placed on a top end of the spacers and cabinets, opposite the base tray. The product display system includes a display header that is slidable along a vertical axis with respect to the product-support structure. The display header includes an elongated header tube which includes sidewall panels. The product display system can include one or more elastic members that connect the display header to the product-support structure and bias the display header to an upright position.

20 Claims, 12 Drawing Sheets

(56) References Cited

U.S. PATENT DOCUMENTS 4,550,839 A * 11/1985 Good ..... A47F 5/0815 248/220.31
4,609,975 A * 9/1986 Badolato ..... A47F 7/021 211/194
4,614,272 A * 9/1986 Shelton ..... A47F 7/021 16/317
4,673,090 A * 6/1987 Crosslen ..... A47F 5/02 16/355
5,048,701 A * 9/1991 Simpson ..... A47F 5/00 211/189
5,286,103 A * 2/1994 Price, Jr. ..... A47B 49/00 211/131.1
5,564,578 A * 10/1996 Smith ..... A47F 5/04 211/133.1
5,896,995 A * 4/1999 Murray ..... B65D 5/4233 206/736
5,979,338 A 11/1999 Salmanson
6,126,131 A 10/2000 Tietz
6,244,194 B1 6/2001 Salmanson
6,386,371 B1 5/2002 Parsons
6,443,317 B1 * 9/2002 Brozak, Jr. ..... A47F 7/021 211/85.1
6,581,330 B1 6/2003 Helsloot
6,607,199 B2 8/2003 Gruber
6,609,466 B2 8/2003 Salmanson
6,722,292 B2 4/2004 Salmanson
D489,198 S * 5/2004 Mason ..... D6/680
6,752,281 B1 * 6/2004 Mason ..... A47F 5/0018 211/131.1
6,857,642 B2 2/2005 Gruber
6,892,876 B1 5/2005 Aubry
6,925,943 B2 8/2005 Salmanson
7,104,553 B2 9/2006 Gruber
7,159,521 B2 1/2007 Salmanson
7,252,200 B1 * 8/2007 Hester ..... A47F 5/116 211/126.16
7,407,086 B2 8/2008 Borio
7,500,574 B1 * 3/2009 Miller, III ..... A47F 5/13 211/195
7,681,783 B2 3/2010 Stephenson
7,766,348 B2 8/2010 McFarland
7,845,894 B2 12/2010 Dickinson
8,091,715 B2 * 1/2012 Roth ..... A47B 57/20 211/187
D667,239 S * 9/2012 Brozak ..... D6/677.3
8,485,370 B2 7/2013 Dewhurst
8,505,753 B2 * 8/2013 Clark ..... A47F 5/10 211/189
8,561,816 B2 10/2013 Martin
8,584,860 B2 11/2013 Orischak
8,720,089 B1 5/2014 Lewis
8,733,563 B2 5/2014 Fadrowski
8,833,573 B2 9/2014 Tomaszewski
8,857,633 B2 10/2014 Dewhurst
8,863,417 B2 10/2014 Gerstner
8,978,280 B2 3/2015 Holt
8,991,624 B2 3/2015 Brozak
9,186,453 B1 11/2015 Russell
9,357,857 B2 * 6/2016 Brozak ..... A47F 5/108
9,370,264 B2 * 6/2016 Markee ..... A47F 5/0043
9,415,893 B2 8/2016 Wintermute
10,213,031 B2 * 2/2019 Cohen ..... A47F 5/0018
11,154,145 B1 * 10/2021 Pfeifer ..... A47F 5/116
2003/0150771 A1 * 8/2003 Mason ..... A47F 5/112 206/736
2005/0274684 A1 * 12/2005 Swanson ..... A47B 43/02 211/78
2006/0260979 A1 * 11/2006 Lutes ..... A47F 5/116 206/768
2007/0000857 A1 * 1/2007 Roth ..... A47F 5/118 211/195
2010/0025344 A1 * 2/2010 Virvo ..... A47F 5/116 211/59.2
2010/0072330 A1 * 3/2010 Tzuo ..... G09F 1/06 248/174
2014/0014602 A1 * 1/2014 Ray ..... A47F 1/04 211/59.2
2014/0014606 A1 * 1/2014 Mestres Armengol ..... A47F 5/116 211/135
2014/0054197 A1 * 2/2014 Buhagiar ..... A47F 5/11 206/756
2014/0158655 A1 * 6/2014 Hawkins ..... A47F 5/0018 211/126.14
2015/0144525 A1 * 5/2015 Luke ..... B65D 5/5253 206/764
2016/0176570 A1 6/2016 Collier
2017/0249874 A1 * 8/2017 Lopez Fern ndez ..... A47F 5/11
2017/0267399 A1 9/2017 Buscema
2017/0297772 A1 10/2017 Davis
2018/0293919 A1 * 10/2018 Ertl ..... A47F 5/114
2019/0000243 A1 * 1/2019 Ertl ..... A47F 5/112
2019/0008290 A1 * 1/2019 Ertl ..... A47F 5/116
2019/0135482 A1 * 5/2019 Pratsch ..... B65D 5/4608
2020/0037787 A1 * 2/2020 Pratsch ..... G09F 15/0062
2020/0375375 A1 * 12/2020 Robinson ..... A47F 5/114

* cited by examiner

PRODUCT DISPLAY SYSTEM AND METHOD

CROSS-REFERENCE TO RELATED APPLICATIONS

This application claims the benefit of priority from U.S. Provisional Application No. 62/713,048, filed Aug. 1, 2018, the entire contents of which are incorporated herein by reference.

BACKGROUND

The present disclosure relates to a product display, and particularly to a product display having a display header and a product-support structure. More particularly, the present disclosure relates to a product display having a display header attached to a product-support structure for showing product indicia related to product stored in the product-support structure to a customer at a retail location.

SUMMARY

A product display in accordance with the present disclosure includes a display header and a product-support structure. The display header is coupled to the product-support structure for showing product indicia related to product stored in the product-support structure to a customer at a retail location.

In illustrative embodiments, the product-support structure includes a plurality cabinets that form an internal mounting pocket. The display header is slidably mounted in the mounting pocket for sliding movement with respect to the product-support structure.

In illustrative embodiments, the display header is mounted to the product-support structure by a plurality of elastic members. The elastic members are configured to move the display header from a retracted shipping position, wherein the display header is located within the product-support structure, to an extended display position wherein the display header extends above the product-support structure for displaying product indicia to a customer.

Additional features of the present disclosure will apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
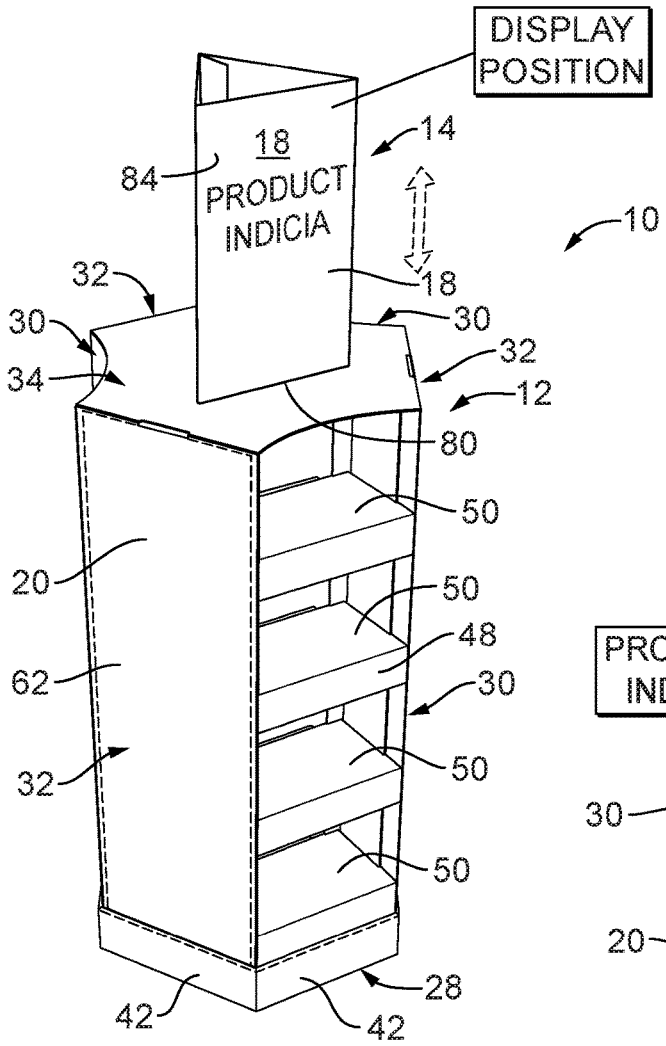
FIG. 1 is a front perspective view of a product display in accordance with the present disclosure showing that the product display includes a display header coupled to a product-support structure for showing product indicia related to products stored in the product-support structure to a customer at a retail location when the display header is in an extended display position.
Figure 2:
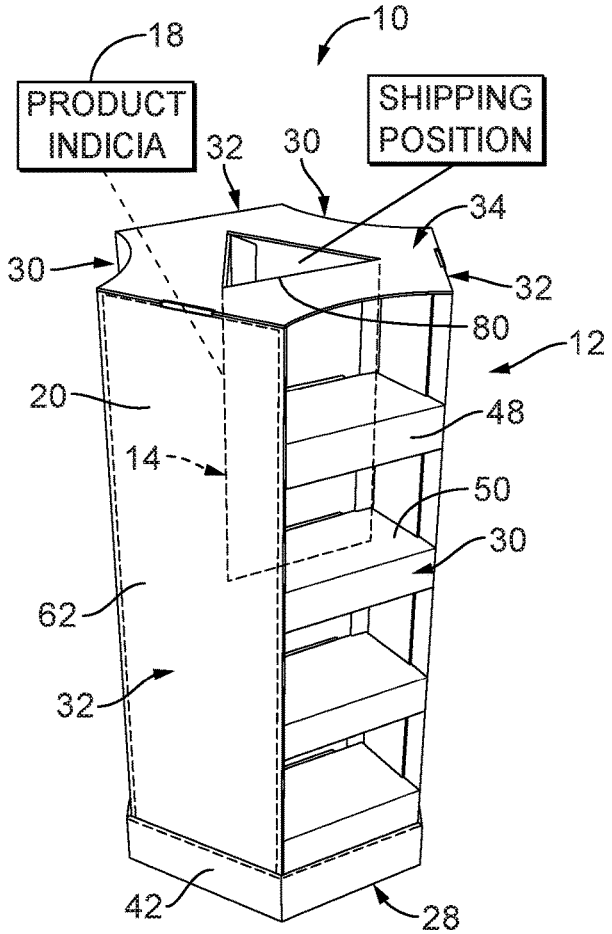
FIG. 2 is a view similar to FIG. 1 showing the display header in a retracted shipping position and suggesting that the display header slides within an interior mounting pocket of the product-support structure to obscure at least a portion of the display header when the display header is moved to the retracted shipping position and to reduce the height of the product display.

A product display 10 in accordance with the present disclosure is shown in FIGS. 1 and 2. Product display 10 includes a product-support structure 12 and a display header 14 coupled to product-support structure 12. Product-support structure 12 includes a bottom end and a top end and is configured to support product for display in a retail setting. Product indicia related to products stored in the product-support structure 12 is positioned in product indicia display area 18 on display header 14. Product indicia in the product indicia display area 18 on display header 14 is visible when display header 14 is in the extended display position as shown in FIG. 1 and is hidden from view when display header 14 is in the retracted shipping position as shown in FIG. 2. Product indicia may also be located in product indicia display area 20 on product-support structure 12. Display header 14 is slidable with respect to product-support structure 12 along a generally vertical central axis of product-support structure 12 between the extended display position as shown in FIG. 1 and the retracted shipping position as shown in FIG. 2.

Figure 3:
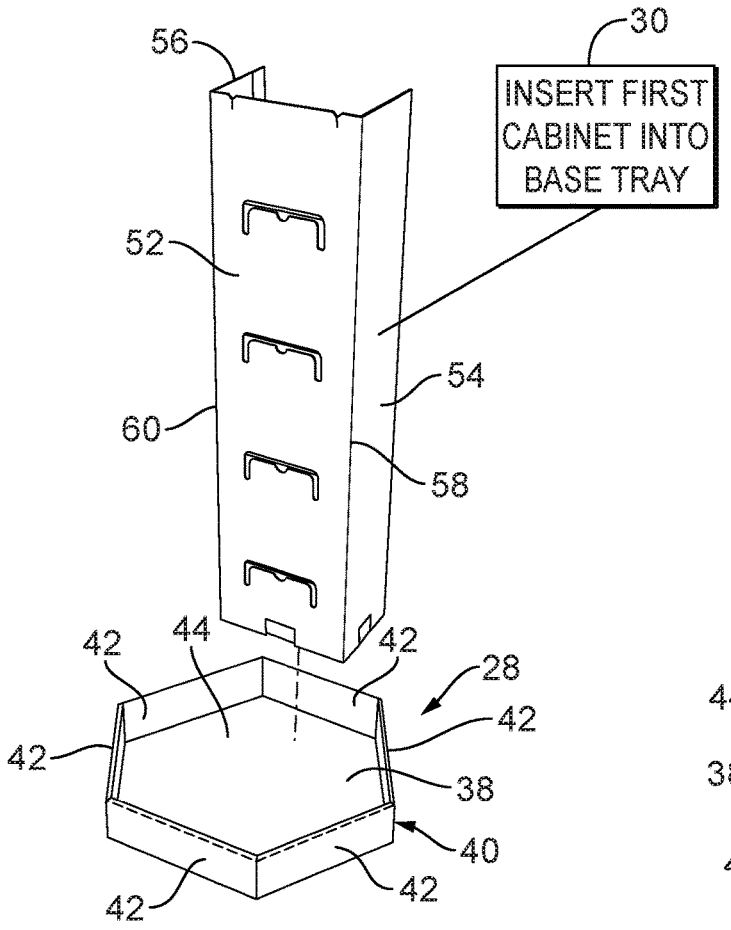
FIGS. 3-6 are a series of views showing a process in accordance with the present disclosure for forming the product display by inserting a first cabinet, a second cabinet, and a third cabinet into a base tray.

Product-support structure 12 of product display 10 includes a base tray 28, a plurality of cabinets 30, a plurality of spacers 32, and a cover plate 34. As shown in FIG. 3, base tray 28 includes a generally horizontal and planar floor 38 having a generally hexagonal configuration with six generally linear peripheral side edges connected one to another end-to-end. Base tray 28 also includes a peripheral wall 40 that extends around the peripheral edge of floor 38 and that extends upwardly generally perpendicular thereto to a top end of peripheral wall 40. Peripheral wall 40 includes a plurality of generally planar sidewalls 42, each formed in the shape of a planar rectangular panel having a generally planar inside surface and a generally planar outside surface. Each sidewall 42 extends between a first end and a second end along a side edge portion of the peripheral edge of floor 38. Sidewalls 42 are connected end-to-end to one another in a generally hexagonal shape. A cavity 44 is formed above floor 38 and within peripheral wall 40. Base tray 28 is shown herein as being generally hexagonal shaped with a peripheral wall 40 having six sidewalls 42, however floor 38 and peripheral wall 40 can be formed in other polygonal shapes with fewer or more sidewalls 42.

Each cabinet 30 includes a front 48 having one or more product storage areas 50. Cabinet 30 also includes a generally planar and rectangular rear wall 52 that extends between a bottom end and a top end of cabinet 30. Cabinet 30 includes a generally planar and rectangular left sidewall 54 and a generally planar and rectangular right sidewall 56 that are spaced apart and generally parallel to one another and that extend from the bottom end to the top end of cabinet 30. Left sidewall 54 and right sidewall 56 extend between front 48 and rear wall 52 of cabinet 30. Left sidewall 54 is connected to rear wall 52 along a vertical and generally linear rear edge 58 and right sidewall 56 is connected to rear wall 52 along a generally vertical and linear rear edge 60.

Figure 7:
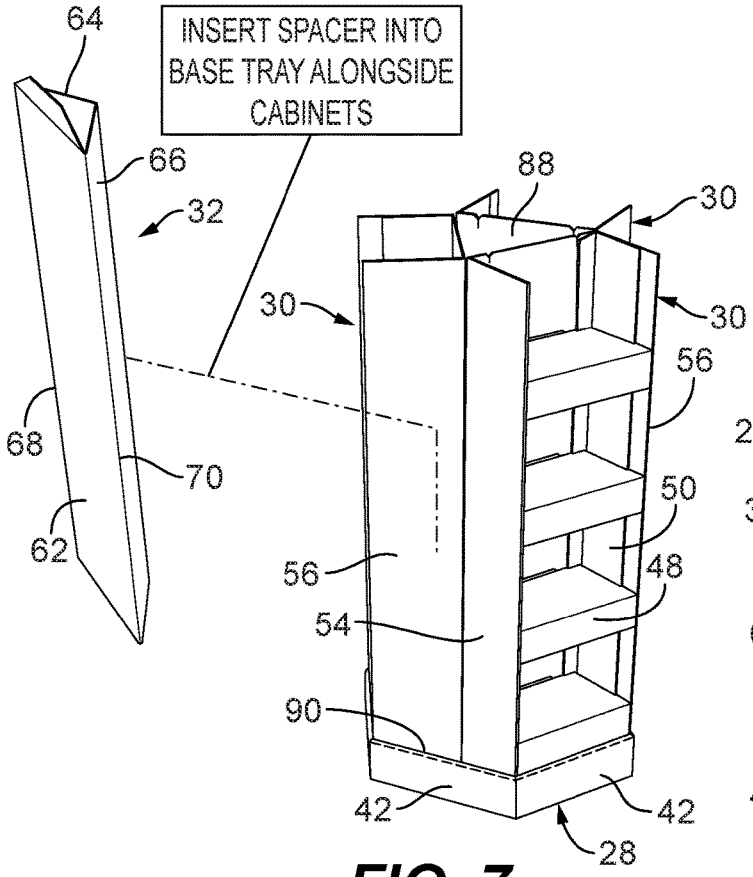
FIGS. 7-10 are a series of views showing a process in accordance with the present disclosure for forming the product display by inserting a first spacer, a second spacer, and a third spacer into the base tray respectively between adjacent cabinets.

Each spacer 32 of product-support structure 12, as shown in FIG. 7, includes a generally planar and rectangular exterior panel 62, a generally planar and rectangular first interior panel 64, and a generally planar and rectangular second interior panel 66. Panels 62, 64 and 66 extend generally vertically between a bottom end and a top end of spacer 32. An outer edge of first interior panel 64 is connected to and along a generally linear and vertical left edge 68 of exterior panel 62. An outer edge of second interior panel 66 is connected to and along a generally vertical and linear right edge 70 of exterior panel 62. An inner end of first interior panel 64 is connected to an inner end of second interior panel 66. Exterior panel 62, first interior panel 64 and second interior panel 66 are arranged with respect to one another such that spacer 32 is generally formed as an isosceles triangle.

Figure 14:
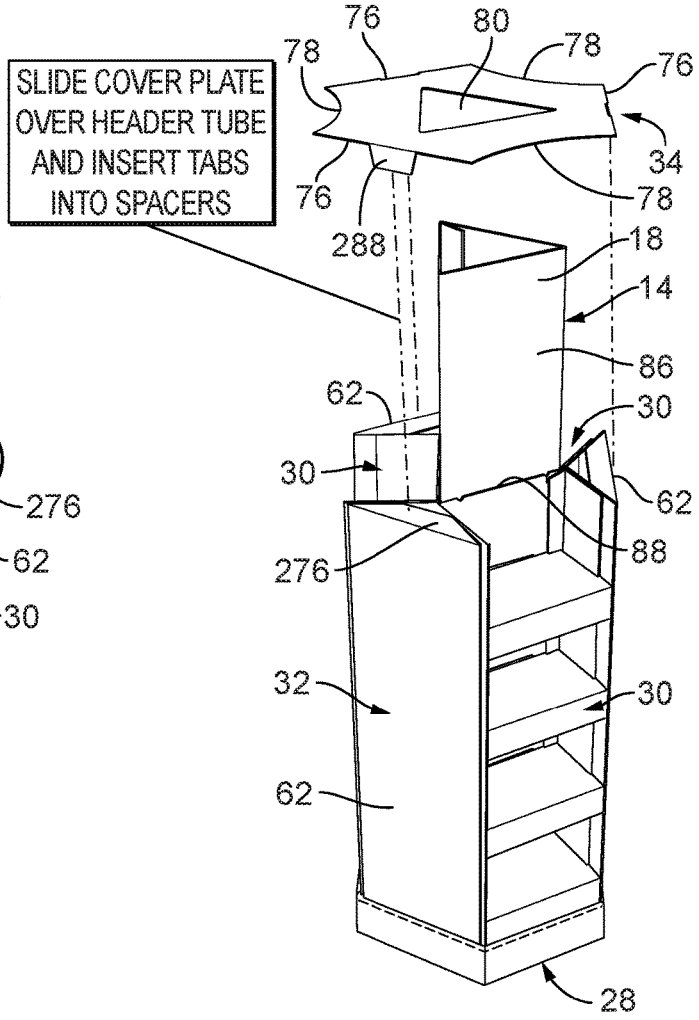
FIG. 14 shows a process in accordance with the present disclosure for forming the product display by sliding a cover plate over the display header and coupling the cover plate to the spacers of the product-support structure.

Cover plate 34 of product-support structure 12 comprises a generally planar panel having a plurality of generally linear side edges 76 and a plurality of curved side edges 78. Curved side edges 78 may be generally concavely curved, or may be formed in other curvilinear or linear configurations as desired. Linear side edges 76 and curved side edges 78 are connected end-to-end with one another in an alternating pattern. As shown in FIG. 14, cover plate 34 includes three linear side edges 76 and three curved side edges 78. It is preferable that a total number of linear side edges 76 and curved side edges 78 equals the number of sidewalls 42 of base tray 28. Cover plate 34 includes a central opening 80. As shown in FIG. 14, opening 80 is in the general form of a triangle, however, opening 80 may be formed in other configurations as desired.

Figure 11:
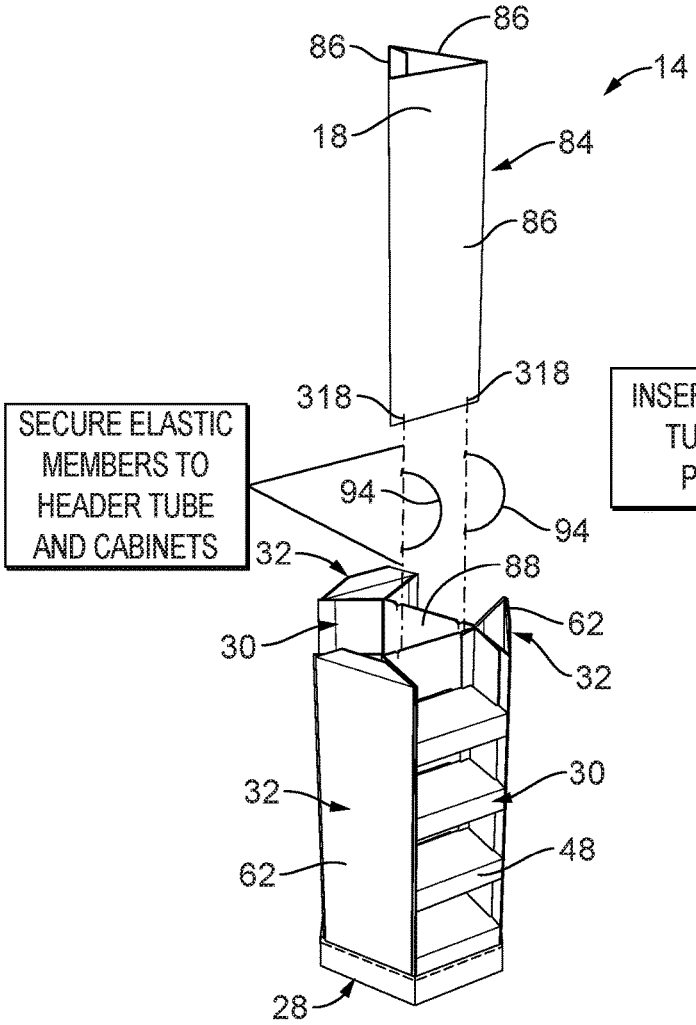
FIGS. 11-13 are a series of views showing a process in accordance with the present disclosure for forming a product display by resiliently coupling the display header to the produce-support structure and inserting the display header into the mounting pocket of the product-support structure.

Display header 14 of product display 10 includes an elongate header tube 84 having a plurality of generally planar and rectangular sidewall panels 86. Sidewall panels 86 are connected edge-to-edge with one another in the general shape of an equilateral triangle. Header tube 84, as shown in FIG. 11, includes three sidewall panels 86, but may include fewer or more sidewall panels as desired. Preferably header tube 84 includes the same number of sidewall panels 86 as the number of cabinets 30 that are included in product-support structure 12. Opening 80 of cover plate 34 conforms to the peripheral configuration of header tube 84 such that header tube 84 is slidably received within opening 80 of cover plate 34. Each sidewall panel 86 of header tube 84 may include product indicia in product indicia display area 20 of each sidewall panel 86.

Figure 4:
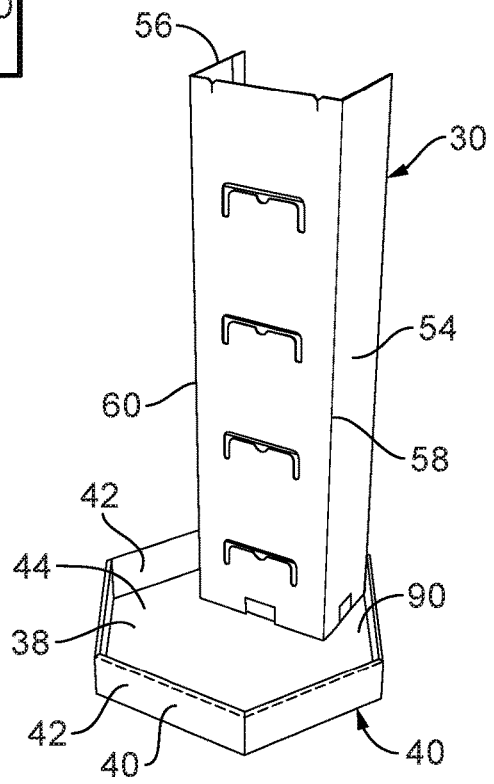

One illustrative process for assembling product display 10 is shown in FIGS. 3-14. As shown in FIGS. 3 and 4, a first cabinet 30 is inserted into the cavity 44 of base tray 28 with front 48 in engagement with the inside surface of a sidewall 42 of peripheral wall 40 of base tray 28. Front 48 of the first cabinet 30 extends along the entire length of the adjacent sidewall 42. Left sidewall 54 and right sidewall 56 of cabinet 30 are generally perpendicular to the adjacent sidewall 42 of base tray 28.

Figure 5:
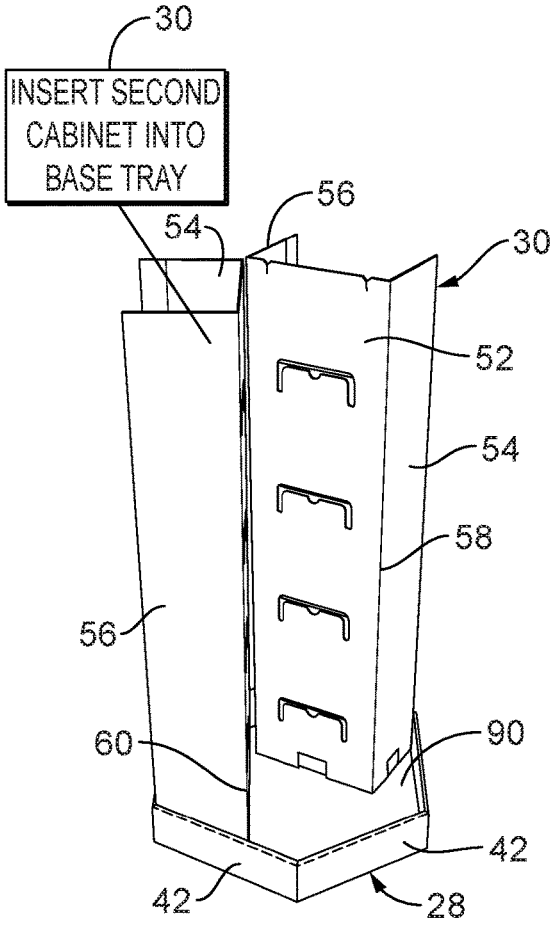

As shown in FIG. 5, a second cabinet 30 is inserted into cavity 44 of base tray 28 with front 48 of second cabinet 30 in engagement with the inside surface of a sidewall 42 of base tray 28 in generally the same manner as the first cabinet 30. Second cabinet 30 is located adjacent a sidewall 42 of peripheral wall 40 such that a sidewall 42 is located between the sidewalls 42 against which the first and second cabinets 30 are located. Rear edge 58 of left sidewall 54 of second cabinet 30 is located closely adjacent to and along rear edge 60 of right sidewall 56 of first cabinet 30.

Figure 6:
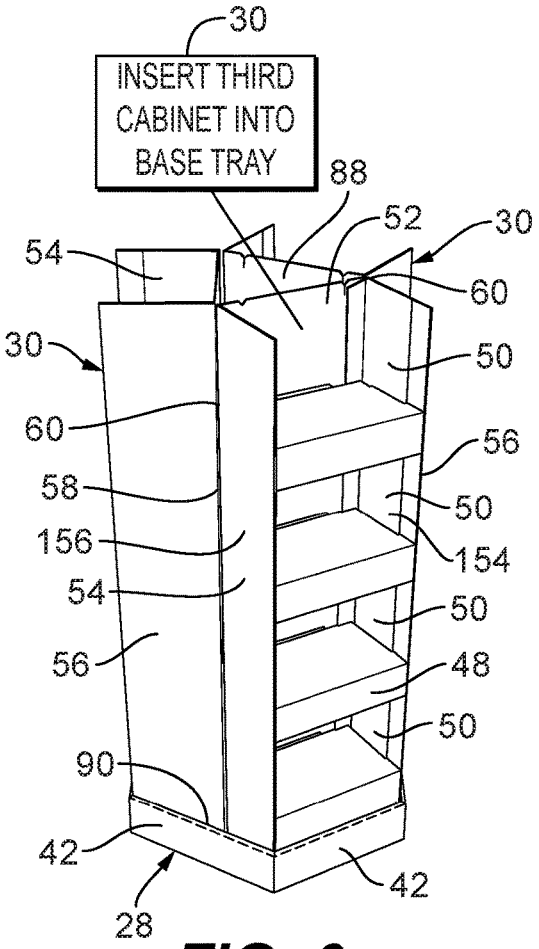

As shown in FIG. 6, a third cabinet 30 is inserted into cavity 44 of base tray 28 with front 48 in engagement with the inside surface of a sidewall 42 of peripheral wall 40 in generally the same manner as first cabinet 30. Rear edge 58 of left sidewall 54 of third cabinet 30 is located closely adjacent to and along rear edge 60 of right sidewall 56 of second cabinet 30. Rear edge 58 of left sidewall 54 of first cabinet 30 is located closely adjacent to and along rear edge 60 of right sidewall 56 of third cabinet 30. The sidewall 42 against which third cabinet 30 is located is spaced apart from the sidewalls 42 against which the first and second cabinets 30 are located by a respective sidewall 42 on each side of third cabinet 30.

The three cabinets 30 are located adjacent every other sidewall 42 of peripheral wall 40 of base tray 28 with a sidewall 42 extending between the first cabinet 30 and a second cabinet 30, between the second cabinet 30 and the third cabinet 30, and between the third cabinet 30 and the first cabinet 30. A generally triangular mounting pocket 88 is formed between rear walls 52 of the three cabinets 30 that extends from the bottom ends of the cabinets 30 to the top ends of the cabinets 30 and that is open at the top as shown in FIG. 6. A generally triangular receptacle 90 is formed in cavity 44 of base tray 28 between the right sidewall 56 of a cabinet 30, the left sidewall 54 of an adjacent cabinet 30, and the sidewall 42 of the peripheral wall 40 that extends between the two adjacent cabinets 30.

Figure 8:
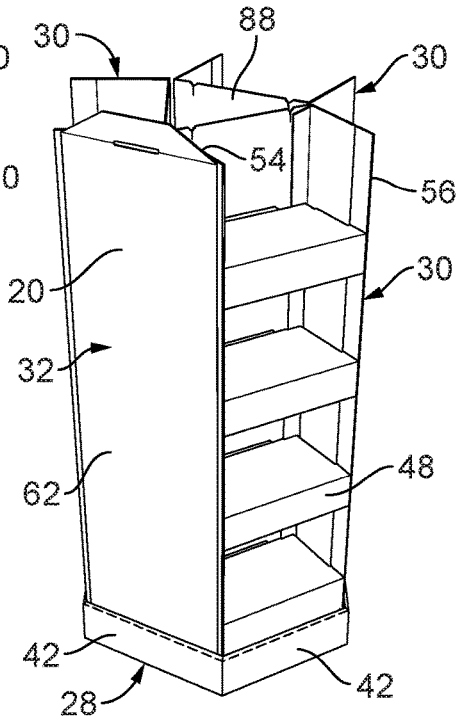

As shown in FIGS. 7-8, a first spacer 32 is inserted into a receptacle 90 of cavity 44 of base tray 28 such that exterior panel 62 of spacer 32 is located adjacent an inside surface of a sidewall 42 of peripheral wall 40 that extends between adjacent second and third cabinets 30. Exterior panel 62 of the spacer 32 extends along the entire length of the adjacent sidewall 42. First interior panel 64 of first spacer 32 extends along and adjacent to right sidewall 56 of second cabinet 30 and second interior panel 66 extends along and adjacent to left sidewall 54 of adjacent third cabinet 30.

Figure 9:
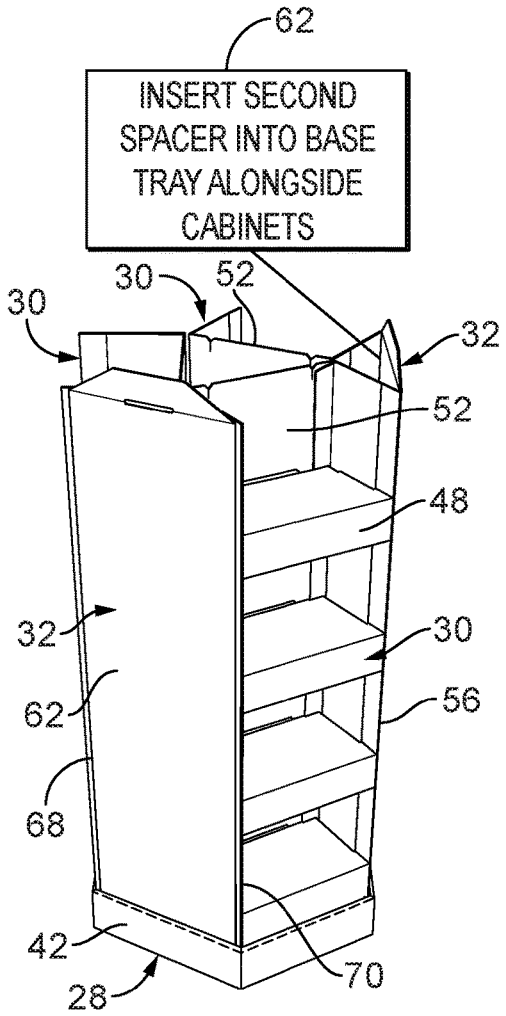

As shown in FIG. 9, a second spacer 32 is inserted into a receptacle 90 of cavity 44 of base tray 28 adjacent a sidewall 42 of base tray 28 that extends between adjacent first and third cabinets 30. First interior panel 64 of second spacer 32 extends along and adjacent to right sidewall 56 of third cabinet 30 and second interior panel 66 extends along and adjacent to left sidewall 54 of first cabinet 30.

Figure 10:
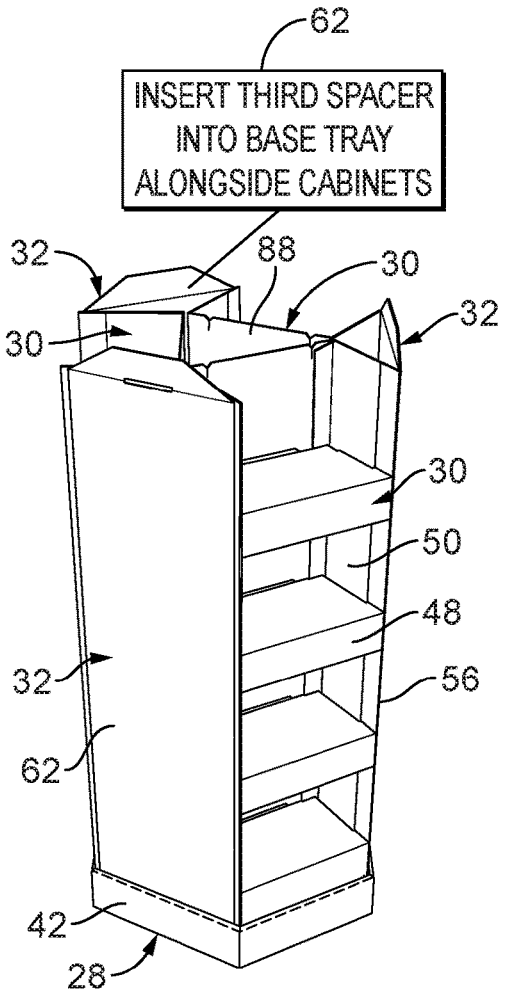

As shown in FIG. 10, a third spacer 32 is inserted into a receptacle 90 of cavity 44 of base tray 28 adjacent a sidewall 42 of base tray 28 that extends between the first and second cabinets 30. First exterior panel 62 of third spacer 32 extends along and adjacent to a sidewall 42 of peripheral 40 that extends between the third cabinet 30 and the first cabinet 30. First interior panel 64 of third spacer 32 extends along and adjacent to right sidewall 56 of first cabinet 30 and second interior panel 66 extends along and adjacent to left sidewall 54 of second cabinet 30.

Each spacer 32 has a bottom end located within cavity 44 of base tray 28 in engagement with floor 38 and a top end located at the same elevation as the top ends of cabinets 30. A spacer 32 is located between adjacent cabinets 30. Product display 10 includes the same number of spacers 32 as there are cabinets 30. The total number of cabinets 30 and spacers 32 is equal to the number of sidewalls 42 in peripheral wall 40 of base tray 28. As shown herein, product-support display 12 includes three cabinets 30 and three spacers 32, but fewer or additional cabinets 30 and spacers 32 can be used as desired.

Figure 12:
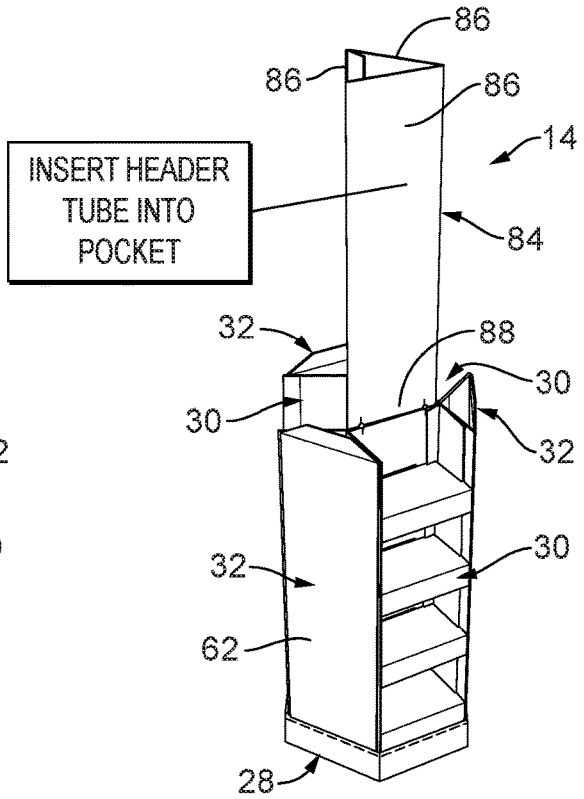

As shown in FIG. 11, one or more elastic members 94 resiliently couple the bottom end of each side panel 86 of header tube 84 of display header 14 to the top end of rear wall 52 of each cabinet 30 to resiliently support display header 14 on product-support structure 12. In some embodiments, elastic members 94 are formed as elongated strands or cords of resiliently stretchable material. Each elastic member 94 includes a barb at opposing ends for securing elastic member 94 to display header 14 and product-support structure 12. As shown in FIG. 12, bottom end of header tube 84 is inserted downwardly through the top opening of pocket 88 and into pocket 88 formed between cabinets 30.

Figure 13:
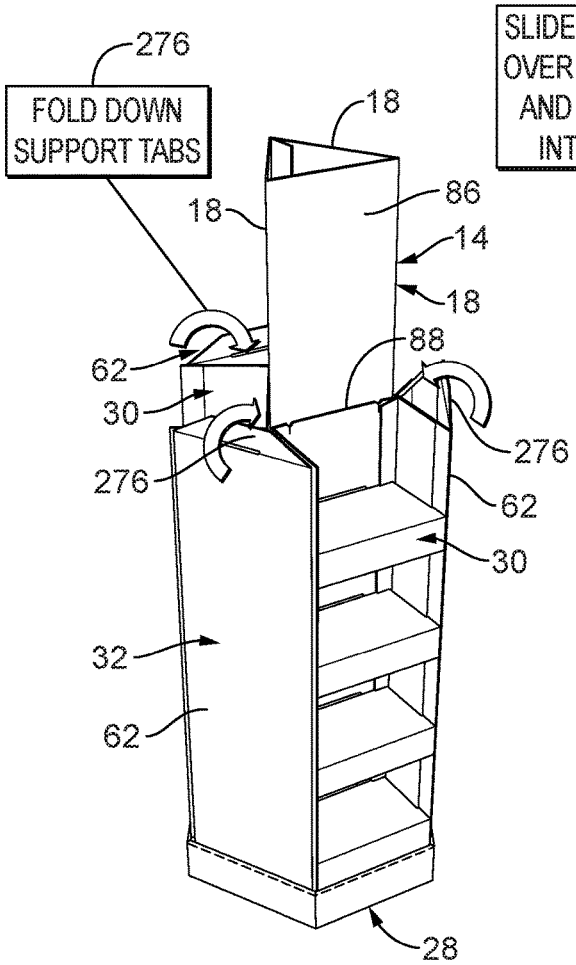

As shown in FIGS. 13 and 14, flaps 276 at the top end of each spacer 32 are folded inwardly and downwardly. Cover plate 34 is placed over a top end of header tube 84 such that header tube 84 extends through opening 80 in cover plate 34. Cover plate 34 is placed on the top ends of cabinets 30 and spacers 32 with locking tabs 288 of cover plate 34 inserted into slots 280 in spacers 32. Product display 10 is thereby assembled as shown in FIG. 1 in the extended display position with the top portion of header tube 84 extending upwardly above cover plate 34 such that product indicia in product indicia display area 18 of header display 14 is visible. Elastic members 94 resiliently support header tube 84 in the extended display position as shown in FIG. 1.

Display header 14 is selectively moveable from the extended display position as shown in FIG. 1 to the retracted shipping position as shown in FIG. 2 by manually pressing downwardly on the top end of header tube 84 until the top end of header tube 84 is approximately coplanar with cover plate 34. As display header 14 is slidably moved along a generally vertical axis from the extended display position to the retracted shipping position, elastic members 94 become stretched, such that elastic members 94 apply a resilient biasing force to display header 14 for moving display header 14 upwardly with respect to product-support structure 12 toward the extended display position. Display header 14 is selectively retained in the retracted shipping position by application of a retention force on the top end of header tube 84. The retention force can be provided by an outer casing that is sized to removably receive product display 10 therein in the retracted shipping position, such as a package, container or packaging film. When the casing is removed from product display 10, elastic members 94 automatically move display header 14 from the retracted shipping position as shown in FIG. 2 to the extended display position as shown in FIG. 1. Movement of display header 14 from the extended display position as shown in FIG. 1 to the retracted shipping position as shown in FIG. 2 decreases the height of product display 10 to the height of product-support structure 12 for ease of storage, transport or shipping.

Figure 15:
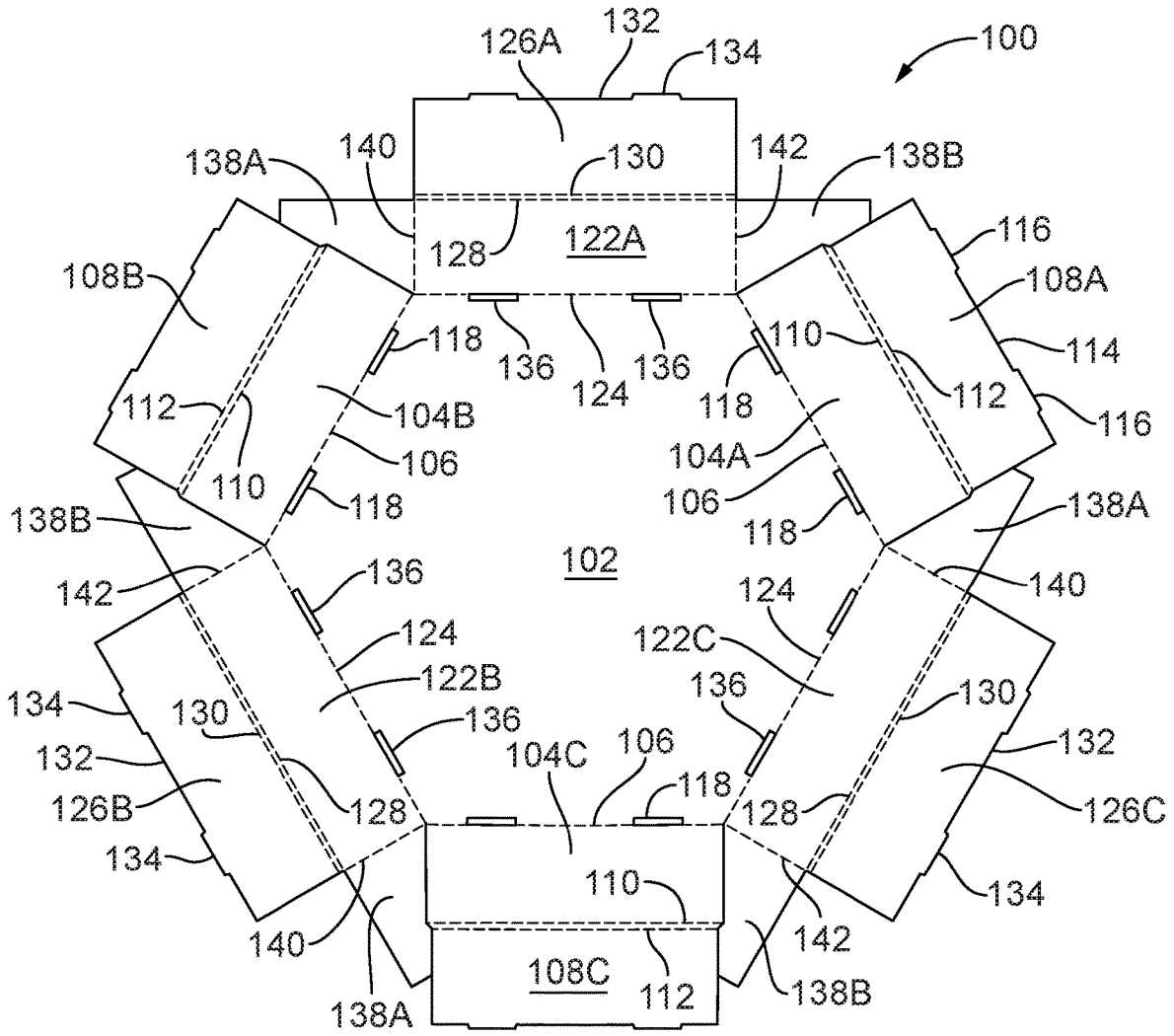
FIG. 15 is a top plan view of an embodiment of a base tray blank in accordance with the present disclosure used to form the base tray of the product-support structure.

A base tray blank 100 used to form base tray 28 is shown in FIG. 15. Base tray blank 100 includes a generally planar inside surface and a generally planar outside surface. Blanks are made, for example, of corrugated material. As shown and described herein, when making reference to a blank of material, solid lines denote a cut line where adjacent portions of material are severed from one another and dashed lines denote a fold line where portions of material are folded relative to one another. In some examples, fold lines are scored or perforated.

Base tray blank 100 includes a generally hexagonal-shaped floor panel 102. Generally rectangular panels 104A-C are coupled to floor panel 102 along respective fold lines 106. Each fold line 106 comprises a generally linear edge of the hexagonal-shaped floor panel 102. A generally rectangular flap 108A-C is respectively coupled to each panel 104A-C by and along fold lines 110 and 112. Fold lines 110 and 112 are spaced apart and parallel to one another. An outer free edge 114 of each flap 108A-C includes one or more spaced apart locking tabs 116. Floor panel 102 includes one or more elongate generally rectangular slots 118 that are spaced apart from one another and that are located adjacent and along each fold line 106.

Base tray blank 100 also includes a plurality of generally rectangular wing panels 122A-C. Each wing panel 122A-C is coupled to floor panel 102 by and along a respective fold line 124. Each fold line 124 comprises a generally linear edge of the hexagonal-shaped floor panel 102. Each fold line 124 extends between adjacent fold lines 106. A generally rectangular flap 126A-C is respectively coupled to each wing panel 122A-C by and along fold lines 128 and 130. Fold lines 128 and 130 are spaced apart and generally parallel to one another. Each flap 126A-C includes a generally linear free edge 132 having one or more spaced apart locking tabs 134. Floor panel 102 includes one or more elongate generally rectangular slots 136 that are spaced apart from one another and that extend along each fold line 124. Wing flaps 138A-B are respectively coupled to opposing ends of each wing panel 122A-C along respective fold lines 140 and 142.

In one illustrative embodiment of a process for forming base tray 28, each wing panel 122A-C is folded along fold line 124 to a generally upright position and generally perpendicular to floor panel 102. Each wing flap 138A-B is folded inwardly along its respective fold line 140, 142 such that wing flaps 138A-B are generally coplanar with a fold line 106. Panels 104A-C are folded upwardly along fold lines 106 to a generally upright position and generally perpendicular to floor panel 102, such that wing flaps 138A-B are located adjacent to the inside surface of panels 104A-C. Flaps 108A-C are folded along fold lines 110 and 112 inwardly and downwardly to trap wing flaps 138A-B between flaps 108A-C and panels 104A-C. Tabs 116 of flaps 108A-C are inserted into slots 118 of floor panel 102 to retain flaps 108A-C in position. Flaps 126A-C are folded along fold lines 128 and 130 to a location adjacent to the inside surface of wing panels 122A-C. Tabs 134 of flaps 126A-C are inserted into slots 136 of floor panel 102 to retain flaps 126A-C in position.

Figure 16:
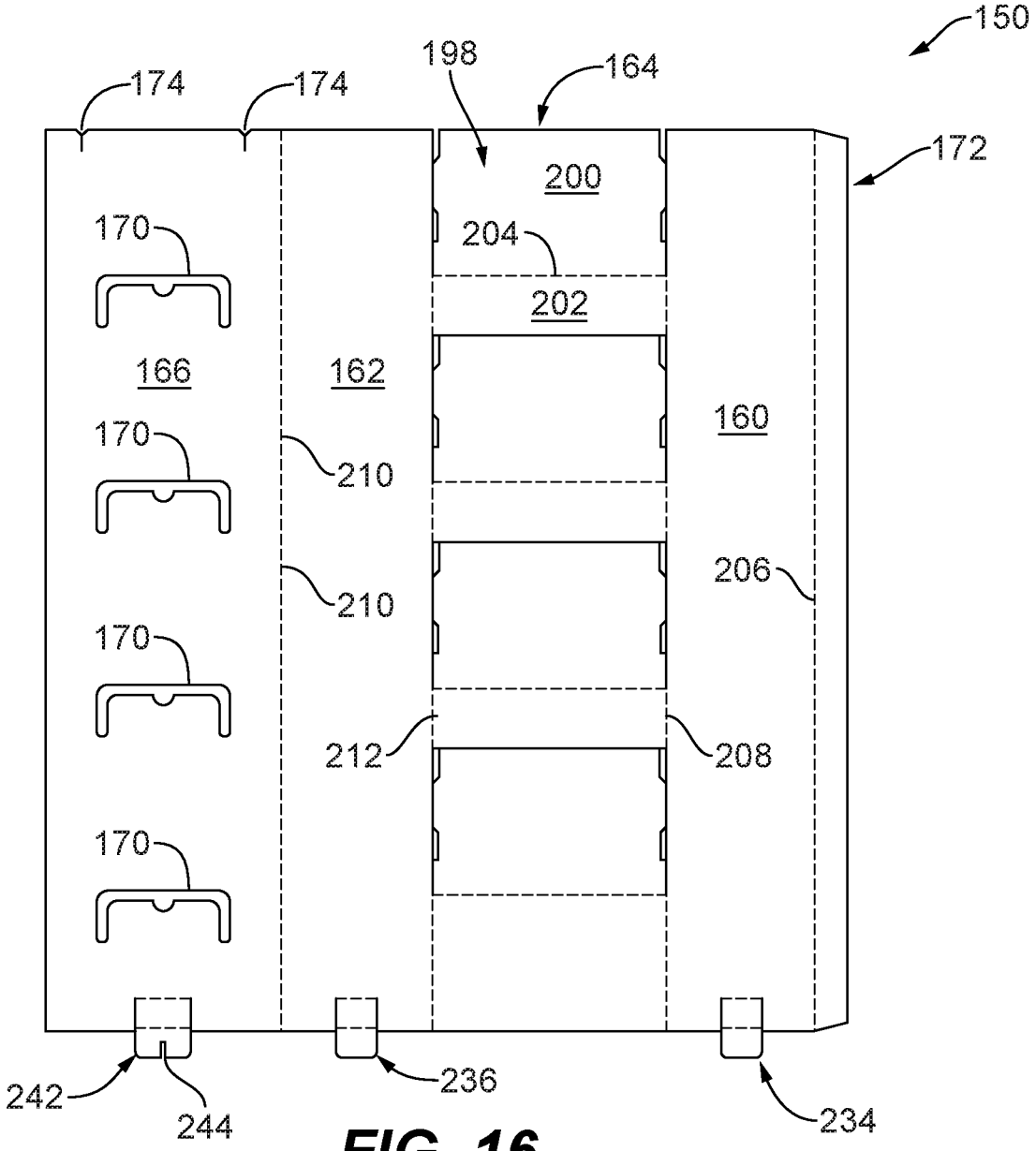
FIG. 16 is a top plan view of an embodiment of a cabinet body blank in accordance with the present disclosure used to form a cabinet of the product-support structure.
Figure 17:
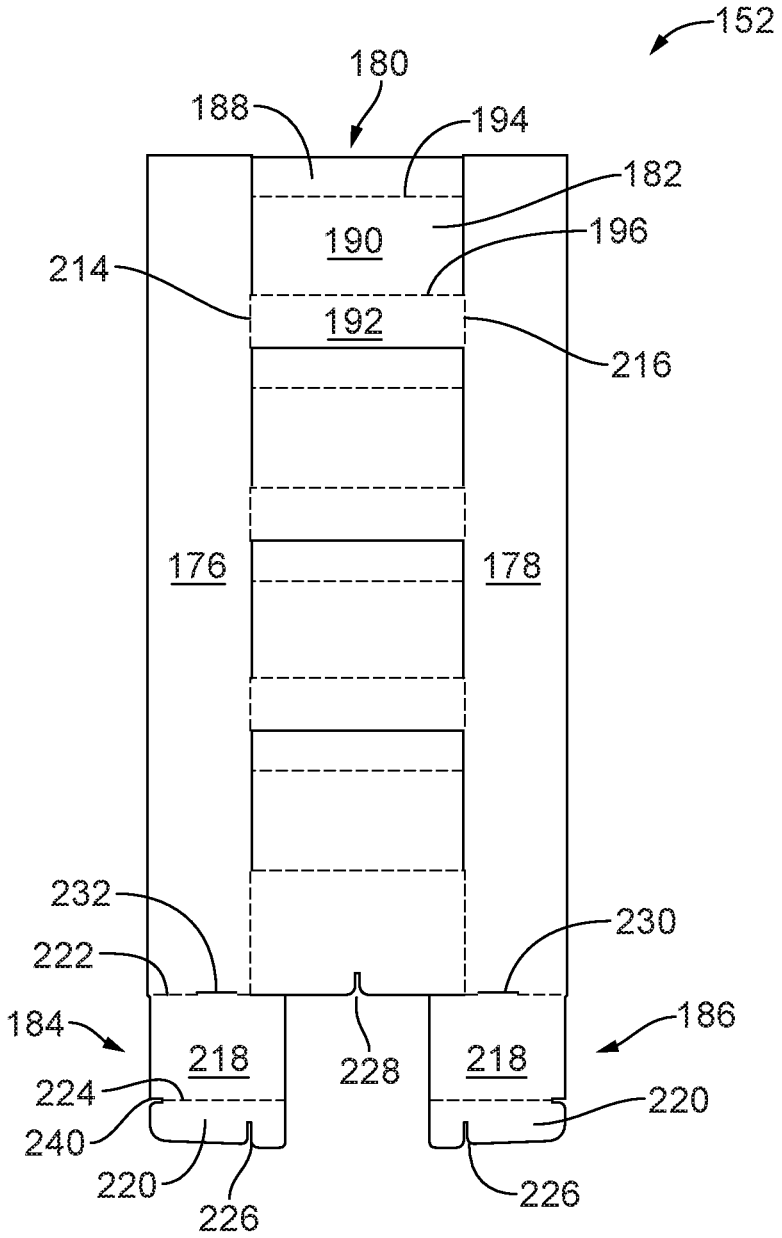
FIG. 17 is a top plan view of an embodiment of a cabinet insert blank in accordance with the present disclosure used in connection with a cabinet body blank to form a cabinet of the product-support structure.

A cabinet body blank 150 and a cabinet insert blank 152 used to form cabinet 30 are shown in FIGS. 16 and 17 respectively. Cabinet 30 is formed as a result of coupling an insert 154 with a tubular body 156. Body 156 is formed by erecting body blank 150. Insert 154 is formed by erecting insert blank 152.

Body blank 150 includes two sidewall panels 160 and 162 coupled to a body shelf-part strip 164, and a back wall panel 166 is coupled to sidewall panel 162. In some embodiments, back wall panel 166 is coupled to sidewall panel 160. Body shelf-part strip 164 is formed to define a plurality of second shelf parts 198 corresponding to a number of shelves in the assembled cabinet 30. Back wall panel 166 is formed to include a plurality of slots 170. Sidewall panels 160 and 162 provide lateral walls of body 156, body shelf-part strip 164 provides a front wall of body 156, and back wall panel 166 provides a back wall of body 156. Panels 160, 162 and 166 and body shelf-part strip 164 fold relative to one another to form body 156, and a retainer flap 172 engages with panel 166 to retain body 156 in a folded position. In some embodiments, an adhesive material couples retainer flap 172 to panel 166.

In the illustrative embodiment, insert blank 152 includes spacer panels 176 and 178 coupled to an insert shelf-part strip 180. Insert shelf-part strip 180 is formed to define a plurality of first shelf parts 182. Bottom-closure flaps 184, 186 are coupled to spacer panels 176 and 178 and configured to fold relative to define a closed bottom of cabinet 30. Panels 176 and 178, insert shelf-part strip 180, and flaps 184 and 186 fold relative to one another to form insert 154.

Each first shelf part 182 of insert shelf-part strip 180 includes a support tab 188, a first floor panel 190, and a support wall band 192. Support tab 188 is foldable relative to first floor panel 190 about a fold line 194 and first floor panel 190 is foldable relative to support wall band 192 about a fold line 196. Each second shelf part 198 of body shelf-part strip 164 includes a second floor panel 200 and a front wall band 202. Second floor panel 200 is foldable relative to front wall band 202 about a fold line 204. Back wall panel 166 is formed to include slots 170. Slots 170 are configured to receive support tabs 188 of first shelf parts 182 to support first floor panel 190 relative to back wall panel 166. A top end of backwall panel 166 includes spaced apart slots 174 that are adapted to receive one or more elastic members 94.

Retainer flap 172 is foldable relative to sidewall panel 160 about a fold line 206. To erect body 156 from body blank 150, sidewall panel 160 is folded relative to body shelf-part strip 164 about a fold line 208 which runs substantially along an entire edge of sidewall panel 160. In one example, adhesive is added to retainer flap 172 and back wall panel 166 is folded relative to sidewall panel 162 about a fold line 210 to engage with retainer flap 172. Sidewall panel 162 is folded relative to body shelf-part strip 164 about a fold line 212 which runs substantially along an entire edge of sidewall panel 162.

Body 156 is moved along fold lines 206, 208, 210 and 212 to open body 156 from a collapsed-flat position, to an expanded assembly position. Sidewall panels 160 and 162 are spaced apart from one another, and body shelf-part strip 164 is spaced apart from back wall panel 166 when body 156 is in the expanded-assembly position. Spacer panels 176 and 178 are folded relative to insert shelf-part strip 180 about fold lines 214 and 216 to partially erect insert 154. Bottom-closure flaps 184 and 186 each include a base panel 218 and a wedge flap 220. Base panels 218 fold relative to spacer panels 176 and 178 about fold lines 222, and wedge flaps 220 fold relative to base panels 218 about fold lines 224, such that notches 226 of bottom closure flaps 184 and 186 engage with a notch 228 of the insert shelf-part strip 180 to define a closed bottom for cabinet 30.

Body 156 is sized to receive insert 154 in an insert-receiving space defined by panels 160, 162 and 166 and body shelf-part strip 164. Insert 154 is configured to be received in body 156 such that spacer panels 176 and 178 extend along sidewall panels 160 and 162 and insert shelf-part strip 180 extends between sidewall panels 160 and 162. In the illustrative embodiment, insert shelf-part strip 180 is generally parallel with body shelf-part strip 164 before folding of shelf parts 198 and 182.

Spacer panels 176 and 178 are configured to engage with back wall panel 166 to space insert shelf-part strip 180 apart from back wall panel 166 and apart from body shelf-part strip 164. In some embodiments, insert shelf-part strip 180 is spaced apart from body shelf-part strip 164 by about one-quarter of a total distance between body shelf-part strip 164 and back wall panel 166. In some embodiments, spacer panels 176 and 178 are sized such that insert shelf-part strip 180 of insert 154 is positioned in confronting relation with body shelf-part strip 164 of body 156. In some embodiments, spacer panels 176 and 178 are sized such that insert shelf-part strip 180 of insert 154 is positioned closer to body shelf-part strip 164 of body 156 than back wall 166.

In one illustrative embodiment, insert blank 152 is formed to include retainer slots 230 and 232. Lock tabs 234, 236 are coupled to body blank 150, and configured to engage with retainer slots 230 and 232, to hold body 156 on insert 154. Each bottom-closure flap 184 and 186 is formed to include a notch 240. A lock tab 242 of body blank 150 is formed to include a notch 244.

To form shelves, and finish assembly of cabinet 30, first and second shelf parts 168 and 182 are folded. A lowest first shelf part 182 is folded relative to body 156 such that support tab 188 of first shelf part 182 engages with the bottom-closure flaps 184 and 186 to at least partially support first shelf part 182 and to at least partially form a shelf of the cabinet 30. A lowest second shelf part 198 is folded relative to body 156 about fold line 204 to engage with first shelf part 182 to form a lowest shelf of cabinet 30. Wedges of second shelf part 198 engage with insert 154 to retain second shelf part 198 in place relative to first shelf part 182.

A next lowest first shelf part 182 is folded relative to body 156 such that support tab 188 of first shelf part 182 engages with slot 170 formed in back wall panel 166 to at least partially support first shelf part 182 and to at least partially form another shelf of the cabinet 30. A next lowest second shelf part 198 is folded relative to body 156 about fold line 204 to engage with first shelf part 182 to form another shelf of cabinet 30. The remaining shelves are formed in a similar manner to assemble cabinet 30.

Bottom-closure flaps 184 and 186 define a closed bottom of cabinet 30. Support wall bands 192 of first shelf parts 182 form cross braces to support second shelf parts 198 and strengthen the shelves. Front wall bands 202 collectively define a front wall of cabinet 30.

Figure 18:
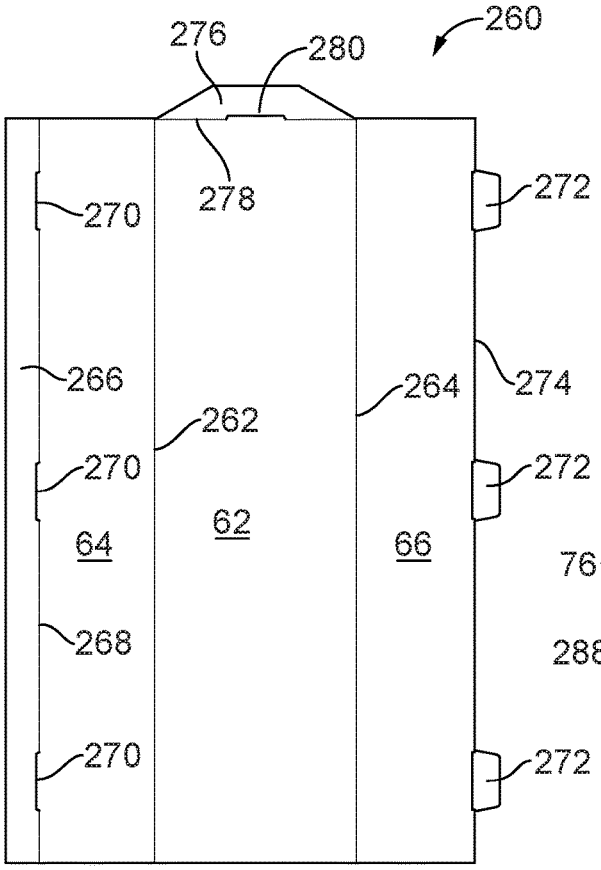
FIG. 18 is a top plan view of an embodiment of a spacer blank in accordance with the present disclosure used to form a spacer of the product-support structure.

A spacer body blank 260 used to form insert spacer 32 is shown in FIG. 18. Spacer body blank 260 includes generally rectangular exterior panel 62, generally rectangular first interior panel 64 coupled to exterior panel 62 by and along fold line 262, and generally rectangular second interior panel 66 coupled to exterior panel 62 by and along fold line 264. A generally rectangular flap 266 is coupled to first interior panel 64 by and along a fold line 268. Flap 266 includes a plurality of spaced apart elongate slots 270 located adjacent to and along fold line 268. A plurality of spaced apart locking tabs 272 are coupled to a free edge 274 of second interior panel 66. Fold lines 262, 264, 268 and free edge 274 are spaced apart and generally parallel to one another. A flap 276 is coupled to the top end of exterior panel 62 by and along a fold line 278. Flap 276 includes an elongate generally rectangular slot 280 that extends along fold line 278.

Spacer 32 is formed from spacer body blank 260 by folding first interior panel 64 with respect to exterior panel 62 along fold line 262, and folding flap 266 with respect to first interior panel 64 along fold line 268. Second interior panel 66 is folded with respect to exterior panel 62 along fold line 264, and locking tabs 272 are inserted into slots 270 to retain exterior panel 62, first interior panel 64 and second interior panel 66 in place with respect to one another in a generally triangular configuration. Flap 276 is folded along fold line 278 to a generally horizontal position that is generally transverse to exterior panel 62.

Figure 19:
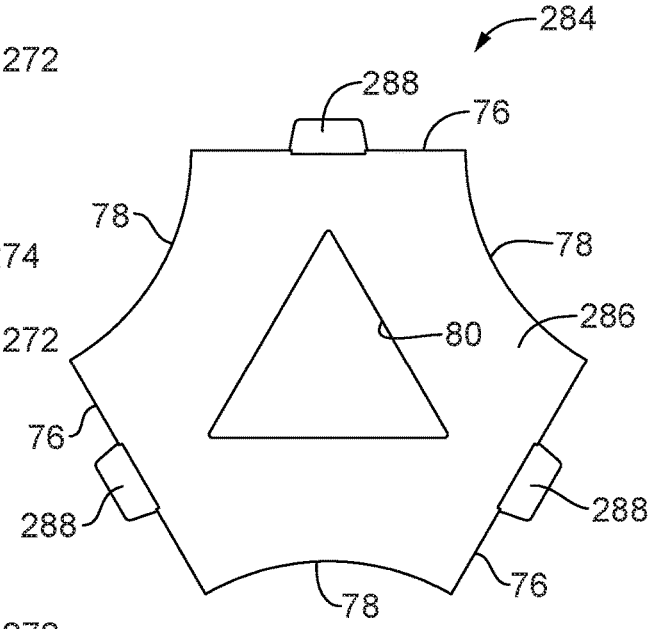
FIG. 19 is a top plan view of an embodiment of a cover plate blank in accordance with the present disclosure used to form the cover plate of the product-support structure.

A cover plate body blank 284 used to form cover plate 34 as shown in FIG. 19. Cover plate body blank 284 includes a generally planar panel 286 having three generally linear side edges 76 and three generally concavely curved side edges 78. Linear side edges 76 and curved side edges 78 extend around the perimeter of panel 286 and are connected end-to-end with one another in an alternating pattern with respect to one another. Opening 80 is formed in panel 286. A locking tab 288 is coupled to panel 286 along each linear side edge 76. Each tab 288 is adapted to be inserted into a slot 280 of spacer 32 to couple cover plate 34 to spacers 32.

Figure 20:
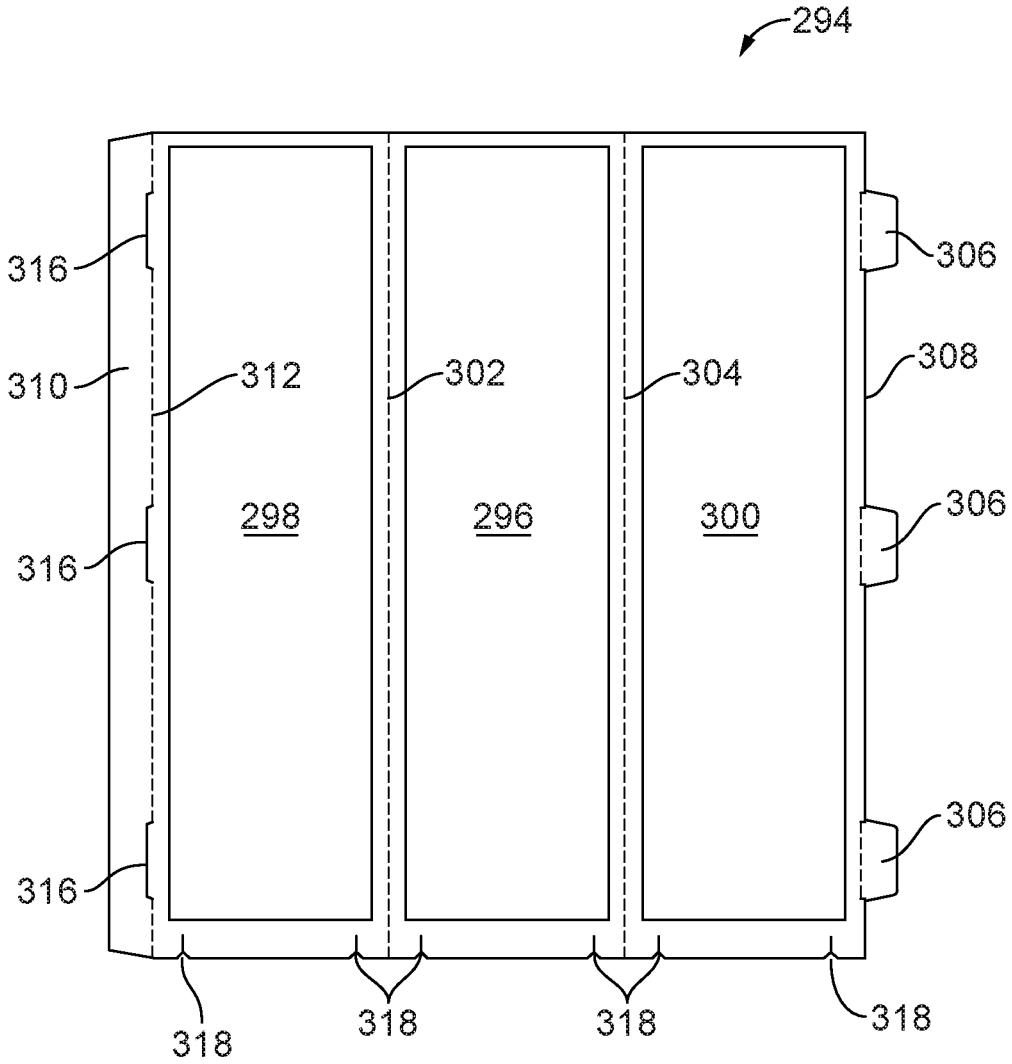
FIG. 20 is a top plan view of an embodiment of a display header blank in accordance with the present disclosure used to form the display header of the product display.

A display header blank 294 for forming display header 14 is shown in FIG. 20. Display header blank 294 includes a generally rectangular center panel 296, a generally rectangular left panel 298, and a generally rectangular right panel 300. Left panel 298 is coupled to center panel 296 by and along a fold line 302. Right panel 300 is coupled to center panel 296 by and along a fold line 304. A plurality of spaced apart locking tabs 306 are coupled to a generally linear free edge 308 of right panel 300. A generally rectangular flap 310 is coupled to left panel 298 by and along a fold line 312. Fold lines 302, 304, 312 and free edge 308 are spaced apart from one another and are generally parallel to one another. Flap 310 includes a plurality of spaced apart generally rectangular elongate slots 316 that extend along fold line 312. Center panel 296, left panel 298 and right panel 300 each include a plurality of spaced apart notches 318 at the bottom end of each panel. Each notch 318 is adapted to receive and retain one or more elastic members 94.

Display header 14 is formed from display header blank 294 by folding flap 310 with respect to left panel 298 along fold line 312, folding panel 298 with respect to center panel 296 along fold line 302, and folding right panel 300 with respect to center panel 296 along fold line 304. Tabs 306 are inserted into respective slots 316 to retain center panel 296, left panel 298 and right panel 300 in place with respect to one another in a generally triangular configuration.

The invention claimed is:

1. A product display system comprising:

a product-support structure including a plurality of cabinets, a base tray, wherein the cabinets are inserted into a cavity in the base tray around a peripheral wall of the base tray;

a cover plate placed on a top end of the cabinets opposite, the base tray, wherein the cover plate comprises an opening; and a display header that is slidable along a vertical axis with respect to the product-support structure through the opening in the cover plate, wherein the display header is retained within a pocket formed between the cabinets of the product-support structure by application of a retention force, wherein the display header is configured to automatically move from a retracted shipping position to an extended display position.

2. The product display system as recited in claim 1, wherein the product-support structure comprises one or more elastic members wherein the one or more elastic members connect the display header to the product-support structure and apply a resilient biasing force to the display header to move the display header to an upright position.

3. The product display system as recited in claim 1, wherein the display header includes three sidewall panels connected together edge-to-edge in the shape of a triangle, and wherein the pocket is formed by rear walls of three cabinets in a triangular shape.

4. The product display system as recited in claim 3, wherein the product-support structure comprises a plurality of elastic members to couple a bottom end of each sidewall panel of the display header to a respective top end of each cabinet in the product-support structure.

5. The product display system as recited in claim 1 wherein the product-support structure further comprises:

a plurality of spacers inserted into the cavity in the base tray in an alternating pattern around the peripheral wall of the base tray.

6. The product display system as recited in claim 1 wherein the display header includes an elongate header tube, including two or more sidewall panels.

7. The product display system as recited in claim 6, wherein the display header tube includes the same number of side wall panels as the number of cabinets that are included in the product-support structure.

8. The product display system as recited in claim 6, wherein the opening conforms to a configuration of the sidewall panels of the display header.

9. A system of blanks for assembling a product display, comprising:

a base tray blank;

one or more cabinet body blanks;

one or more cabinet insert blanks;

a cover plate body blank placed on a top end of the one or more cabinet body blanks opposite the base tray blank, wherein the cover plate body blank comprises an opening;

and a display header blank;

wherein the base tray blank is configured to form a base tray, each cabinet body blank is configured to couple together with a cabinet insert blank to form a cabinet;

wherein each cabinet is configured to insert into the base tray; and wherein the display header blank is configured to form a display header, wherein the display header is slidable with respect to the one or more cabinet body blanks through the opening of the cover plate body blank such that the display header is configured to automatically move from a retracted shipping position to an extended display position.

10. The system of blanks as recited in claim 9, wherein the display header blank includes:

a plurality of foldably connected rectangular panels;

a plurality of locking tabs on a first edge of the blank which are configured to insert into respective slots in a flap foldably connected to a second edge of the blank; and a plurality of notches along a bottom edge of each of the rectangular panels, said notches being configured to receive and retain one or more elastic members.

11. The system of blanks as recited in claim 9, wherein the cover plate body blank is configured to form a cover plate to be placed on the top end of the cabinets opposite the base tray, wherein the cover plate body blank includes a planar panel having:

a plurality of linear side edges;

a plurality of concavely curved side edges, wherein the linear side edges and curved side edges alternate around the perimeter of the planar panel;

a plurality of locking tabs coupled to the planar panel along each of the linear side edges; and an opening in the middle of the planar panel.

12. The system of blanks as recited in claim 9, further comprises one or more spacer body blanks, each spacer body blank is configured to form a spacer, wherein each spacer is configured to insert into the base tray, wherein the spacer body blank includes:

an exterior panel foldably connected to first and second interior panels;

a plurality of locking tabs connected to the first interior panel which are configured to insert into respective slots in a flap foldably connected to the second interior panel; and a flap foldably connected to the exterior panel, wherein a slot is located within the foldable connection between the flap and the exterior panel.

13. The system of blanks as recited in claim 12, wherein a number of cabinet body blanks, cabinet insert blanks, and spacer body blanks is the same, and each cabinet body blank is sized to receive a respective cabinet insert blank.

14. The system of blanks as recited in claim 9, wherein each cabinet body blank includes:

a body shelf-part strip foldably connected to an opposed pair of first and second sidewall panels;

a back wall panel foldably connected to the second sidewall panel opposite the body shelf-part strip, wherein the back wall panel includes a plurality of slots therein and a plurality of top end slots configured to receive one or more elastic members; and a flap foldably connected to the first sidewall panel.

15. The system of blanks as recited in claim 14, wherein each cabinet insert blank includes:

an insert shelf-part strip foldably connected to an opposed pair of spacer panels; and a pair of base panels foldably connected to the spacer panels, said base panels each including respective notches configured to engage with a notch in the insert shelf-part strip to define a closed bottom for the cabinet;

wherein the insert shelf-part strip includes a plurality of first shelf parts, and the body shelf-part strip includes a plurality of second shelf parts, wherein the first shelf parts and second shelf parts are configured to fold together to form a plurality of shelves in the cabinet.

16. The system of blanks as recited in claim 9, wherein the base tray blank includes:

a floor panel with a plurality of slots;

a plurality of rectangular panels foldably connected to the floor panel, wherein each of the rectangular panels is foldably connected to a respective rectangular flap, opposite the floor panel; and a plurality of wing panels foldably connected to the floor panel, wherein each of the wing panels is foldably connected to a respective wing flap, opposite the floor panel, and each wing panel is foldably connected to a pair of opposed end wing flaps;

wherein each of the rectangular flaps and wing flaps has one or more tabs connected thereto, said tabs being configured to interface with slots in the floor panel.

17. A process for forming a product display comprising:

forming a base tray from a base tray blank;

forming a plurality of cabinet bodies from a plurality of cabinet body blanks;

forming a plurality of cabinet inserts from a plurality of cabinet insert blanks;

forming a plurality of cabinets by coupling the cabinet bodies with the cabinet inserts;

forming a plurality of spacers from spacer body blanks;

forming a cover plate from a cover plate body blank;

forming a display header from a display header blank;

inserting a plurality of cabinets into the base tray;

inserting a plurality of spacers into the base tray, wherein the spacers fit between the cabinets;

inserting the display header into a pocket formed between the plurality of cabinets; and placing the cover plate over a top end of the spacers, cabinets and display header such that the display header extends through an opening in the cover plate.

18. The process as recited in claim 17, further comprising coupling the bottom end of each of a plurality of side panels of the display header to the top end of each of the cabinets with one or more elastic members.

19. The process as recited in claim 17, wherein the display header is configured to be retained in a retracted shipping position.

20. The process as recited in claim 19, wherein the display header is configured to automatically move from the retracted shipping position into an extended display position.

* * * * *